US005505036A

United States Patent [19]

Wiles

[11] Patent Number: 5,505,036

[45] Date of Patent: Apr. 9, 1996

[54] UTILITY POLE BEAM WITH IMPROVED LOAD TRANSFER

[75] Inventor: James R. Wiles, Graham, Tex.

[73] Assignee: Lewtex Technological Manufacturing, Inc., Graham, Tex.

[21] Appl. No.: 410,834

[22] Filed: Mar. 27, 1995

[51] Int. Cl.[6] ..... E04C 2/54

[52] U.S. Cl. ..... 52/787.1; 411/546; 52/736.2

[58] Field of Search ..... 52/40, 697, 726.9, 52/736.2, 737.6, 309.2, 787.1; 411/383, 546, 547; 248/340

[56] References Cited

U.S. PATENT DOCUMENTS

| | | | |
|---|---|---|---|
| 2,209,580 | 7/1940 | Sargent | 52/787.1 X |
| 2,232,625 | 7/1943 | Seaman | 52/787.1 X |
| 2,318,396 | 5/1943 | Hoyt . | |
| 3,083,796 | 4/1963 | Bell | 411/546 X |
| 3,362,737 | 1/1968 | Cobb | 411/546 X |
| 3,603,717 | 9/1971 | Scott . | |
| 4,262,047 | 4/1981 | Barnett et al. . | |
| 4,705,425 | 11/1987 | Okawa | 411/546 X |
| 5,040,917 | 8/1991 | Camuffo | 411/546 X |
| 5,228,260 | 7/1993 | Dziedzic . | |

*Primary Examiner*—Carl D. Friedman
*Assistant Examiner*—Beth A. Aubrey
*Attorney, Agent, or Firm*—James E. Bradley; Grady K. Bergen

[57] ABSTRACT

An improved composite crossarm for utility poles is disclosed having an outer casing of resin impregnated fiberglass with first and second load walls which are joined together by laterally spaced apart opposite sidewalls. Each sidewall is generally parallel to the other and is provided with an aperture. A load bearing member or bolt extends between the first and second load walls and has opposite ends which extend through the outer casing for coupling to an attachment member for securing a load to the composite crossarm. At least one end of the load bearing member has a wall engagement portion which seats against the exterior surface of the first load wall. A cylindrical sleeve is located within the interior of the outer casing between the first and second load walls and has a length substantially equal to the distance between the first and second load walls. This allows the load transfer body to abut against the interior surfaces of the first and second load walls when force is exerted on the attachment member. A cross member is closely received within the apertures of the sidewall and is fixed to the load transfer body. This causes force to be transferred to the sidewalls from the load transfer body.

20 Claims, 2 Drawing Sheets

UTILITY POLE BEAM WITH IMPROVED LOAD TRANSFER

BACKGROUND OF THE INVENTION

1. Field of the Invention

This invention relates to a composite beam, such as those used as crossarms for utility poles, having improved characteristics for transferring force more effectively over the beam to prevent structural weakening and failure.

2. Description of the Prior Art

Composite beams used as crossarms for utility poles have been proposed over the past few years for replacing wooden crossarms. These crossarms are usually formed of resin impregnated fiberglass materials. The composite crossarms are light, flexible, non-conductive and resistant to deterioration. Although an improvement over the wooden crossarms, composite crossarms have some disadvantages.

Composite fiberglass beams are typically formed as an outer casing or shell of resin impregnated fiberglass having a rectangular cross section. The outer casing may or may not be filled with a light weight filler material. Because certain areas of the cross arm encounter higher amounts of stress, these areas are typically reinforced more than others. Bolts used for mounting and stationing the crossarm are usually fastened to the crossarm by passing the bolts through the crossarm through holes located in opposite walls of the outer casing. Stress applied from the bolts often is concentrated around the corners of the casing where the opposite walls are joined. Even with reinforcement in these areas, the relative thinness of the walls at the corners and the high shear stresses that are encountered can result in failure under extreme loading. This is particularly a problem with dead end poles, which are subjected to much force.

What is needed is a composite beam construction that can withstand large amounts of force, such as applied by bolts, by spreading the force more uniformly over the beam to thus prevent failure during extreme loading.

SUMMARY OF THE INVENTION

A composite beam is formed having an outer casing of resin impregnated fiberglass. The outer casing has first and second load walls which are joined together by laterally spaced apart opposite sidewalls. Each load wall has an interior and exterior surface. The sidewalls are generally parallel to each other with each sidewall having an aperture. An attachment member is provided for securing the load to the composite beam.

A load bearing member extends between the first and second load walls and has opposite first and second ends which extend through the first and second load walls, respectively, of the outer casing. The attachment member is coupled to the second opposite ends of the load bearing member. The other end of the load bearing member has a wall engagement portion which seats against the exterior surface of the first load wall so that force is exerted against the first load wall when the load is secured to the attachment member.

A rigid load transfer body is located within the interior of the outer casing between the first and second load walls. The load transfer body has a length substantially equal to the distance between the first and second walls so that the load transfer body abuts against the interior surfaces of the first and second load walls when force is applied to the first wall by engagement portion of the load bearing member. A cross member is closely received within the apertures of the sidewalls and is fixed to the load transfer body for transferring force imposed on the load transfer means to the sidewalls.

DESCRIPTION OF THE PREFERRED EMBODIMENT

Figure 1:
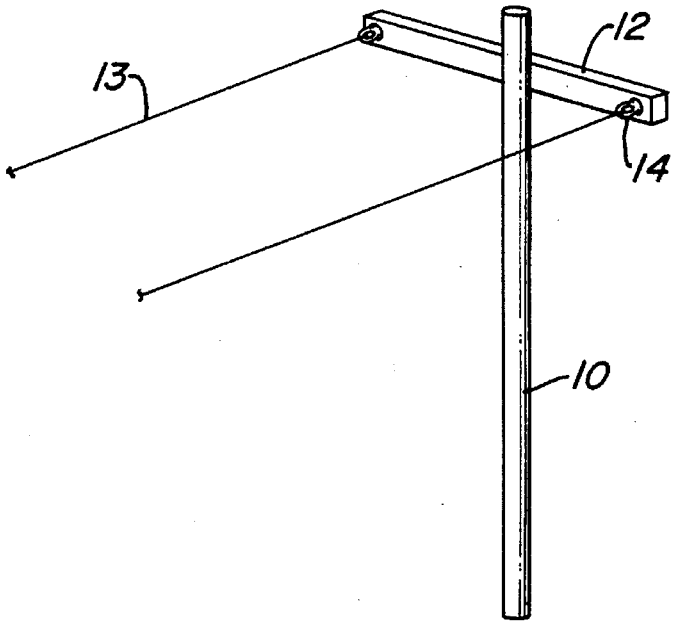
FIG. 1 a perspective view of a composite crossarm used in conjunction with a utility pole and constructed in accordance with the invention.

Referring to the Figures, FIG. 1 shows a utility pole 10 having a composite crossarm 12 used for supporting utility lines 13 attached to the crossarm 12 by means of eyelets 14. The utility pole 10 is shown as a "dead end" pole that is located at the end of a line of utility poles and which is typically supported by means of guy wires (not shown) stationed to the ground. That portion of the crossarm 12 with the attached eyelet 14 is shown in further detail in FIGS. 2–4.

Figure 2:
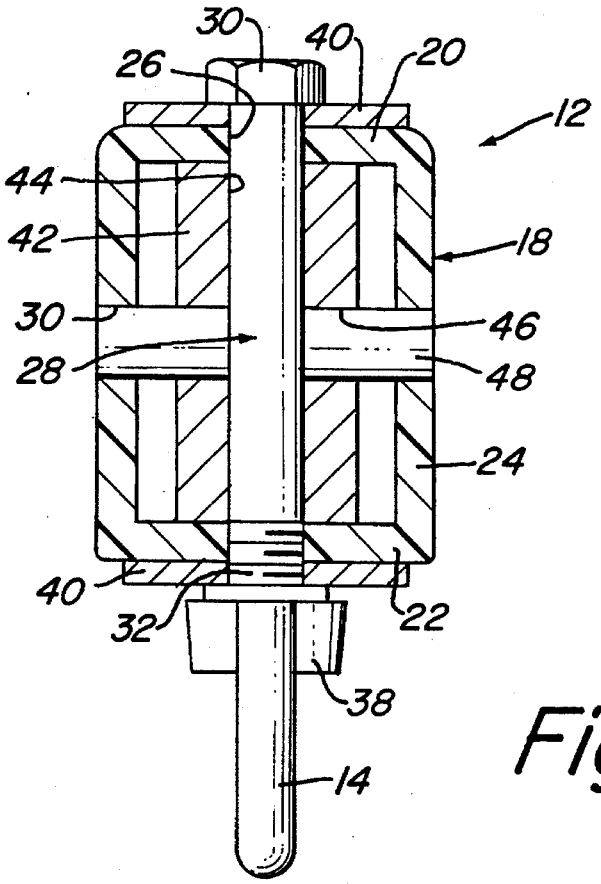
FIG. 2 is a transverse cross-sectional view of the composite crossarm of FIG. 1 showing a load bearing assembly constructed in accordance with the invention.
Figure 3:
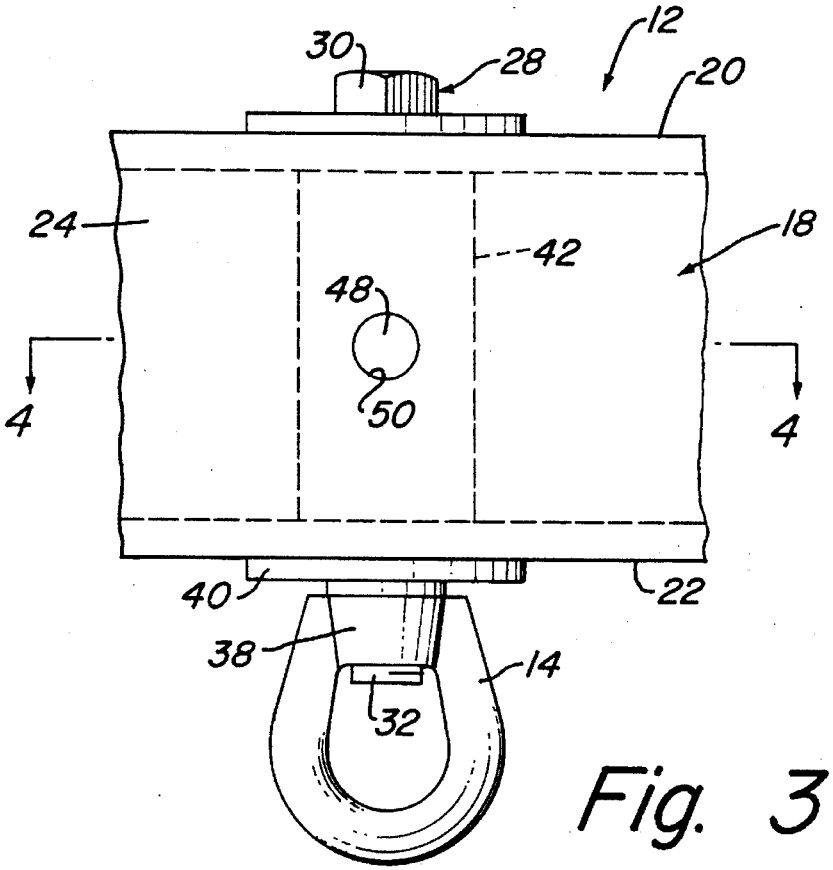
FIG. 3 is a side view of a portion of the crossarm of FIG. 1 showing the load bearing assembly and constructed in accordance with the invention.

The crossarm 12 has an outer casing 18 of resin impregnated fiberglass material. An example of a suitable fiberglass outer casing is disclosed in U.S. patent application Ser. No. 08/107,865, filed Aug. 18, 1993, presently pending. Referring to FIG. 2, the outer casing 18 has opposite upper and lower load walls 20, 22 which are parallel to each other and are joined together by opposite sidewalls 24. The words "upper", "lower", and "side" are used herein for convenience only with reference to FIG. 2. It should be noted that the crossarm 12 may be oriented in directions other than as shown in FIG. 2. The sidewalls 24 are laterally spaced apart and are parallel to each other so that the outer casing 18 has a generally rectangular cross section.

Formed in the upper and lower load walls 20, 22 are holes 26 which are aligned for receiving a bolt 28. The bolt 28 is of conventional design and is provided with a head 30 at one end and a helical threaded portion 32 at the opposite end. The bolt 28 extends through the outer casing 18 through the holes 26 of the upper and lower load walls 20, 22 with the eyelet 14 coupling to the threaded portion 32 of the bolt 28. The eyelet 14 is provided with a base 38 with internal threads (not shown) for engaging the threads of the threaded portion 32 of the bolt 28.

Steel end plates 40 seat against the exterior surfaces of the upper and lower walls 20, 22 and are held in place by the bolt head 30 and eyelet 14. The end plates 40 are generally rectangular and sized to overlay the width of the upper and lower load walls 20, 22. Conventional washers may also be used for the end plates.

Figure 4:
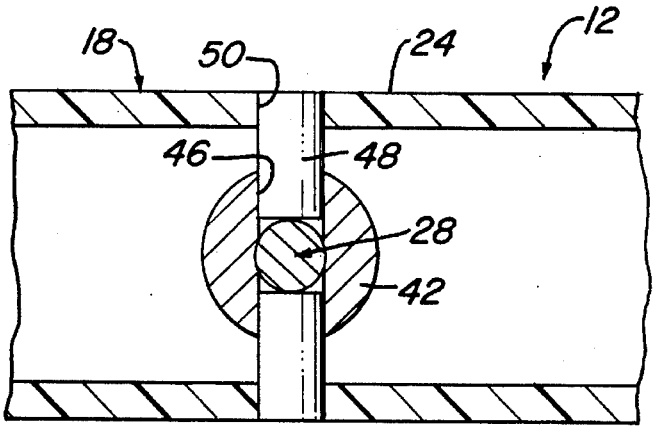
FIG. 4 is a cross-sectional bottom view of the crossarm of FIG. 3 taken along the lines 4—4.

Positioned within the interior of the outer casing 18 is a cylindrical steel sleeve 42. The sleeve 42 has a length which is substantially equal to the distance between the inner surfaces of the upper and lower walls 20, 22. The sleeve 42 has a central bore 44 and surrounds the shank of the bolt 28 with the central bore 44 being slightly larger in diameter than the diameter of the shank of the bolt 28. This allows the sleeve 42 to move slightly along the length of the bolt 28 between the upper and lower load walls 20, 22. Two transverse cylindrical holes 46 extend radially outward from the central bore 44 to the exterior side surface of the sleeve 42. As shown in FIGS. 2 and 4, the two holes 46 are aligned 180 degrees apart.

When the sleeve 42 is properly positioned within the interior of the outer casing 18, the holes 46 of the sleeve 42 align with apertures 50 formed in the midsection of each sidewall 24. Each of the holes 46 holds a steel cross pin or rod 48 which extends outward and is closely received within one of the apertures 50 formed in the mid-portion of the sidewalls 24 so that the cross pin 48 is held tightly in place.

In constructing the crossarm 12, a length of outer casing 18 may be cut to size and formed with the holes 26, 50 in the upper and lower walls 20, 22 and sidewalls 24, respectively. These may be drilled, punched or otherwise formed in the fiberglass material of the outer casing 18. The cylindrical sleeve 42 is then positioned within the interior of the outer casing 18 so that the central bore 44 is aligned with the holes 26 of the upper and lower load walls 20, 22. The holes 46 of the sleeve 42 are also aligned with the apertures 50 of the sidewalls 24. The bolt 28 is inserted through the holes 26 of the upper and lower walls 20, 22 with the end plate 40 being positioned below the bolt head 30. The eyelet 14 is then threaded onto the threaded portion 32 of the bolt 28 with the other endplate 40 abutting the outer surface of the lower wall 22. The cross members 48 are then inserted through the apertures 50 of the sidewalls 24 and into the holes 46 of the sleeve 42.

When the crossarm 12 is constructed as described above, force exerted on the eyelet 14, such as that exerted by the utility lines 13 (FIG. 1), causes the bolt 28 to force the end plate 40 and upper wall 20 downward, as viewed in FIG. 2. This causes the fiberglass material of the upper wall 20 to deflect slightly and push against the upper end of the steel sleeve 42. Because the cross pins 48 are rigidly secured to the sleeve 42, force exerted against the sleeve by the upper wall 20 is transferred to the sidewalls 24 through the cross pins 48.

The design of the invention allows much greater forces to be applied to the crossarm before failure occurs. Forces exerted on the eyelet 14 are less likely to result in failure of the crossarm 12. This is due to the fact that the cross pins spread the force exerted on the upper load wall to the sidewalls. This force is perpendicular to the thickness of the walls instead of parallel. The sidewalls are much better able to withstand shear stresses in this direction than those parallel to the wall's thickness, such as would occur to the upper walls without the cross pins and steel sleeve. This is seen in prior art crossarms with failure typically occurring along the corners where the upper and lower walls are joined to the sidewalls.

While the invention has been shown in only one of its form, it should be apparent to those skilled in the art that it is not so limited but is susceptible to various changes without departing from the scope of the invention.

I claim:

1. An improved composite beam comprising in combination:

an outer casing of resin impregnated fiberglass having first and second load walls which are joined together by laterally spaced apart opposite sidewalls, the first and second load walls each having an interior and exterior surface, and wherein each sidewall is generally parallel to the other with each of the sidewalls having an aperture formed therein;

an attachment member for securing a load to the composite beam;

load transfer means having a central portion located within the interior of the casing between the first and second load walls, and having first and second opposite ends which extend from the central portion through the first and second walls, respectively, with the attachment member being coupled to the second end, the first end having a wall engagement portion which seats against the exterior surface of the first load wall; and cross member means which is closely received within the apertures of the sidewalls and which is fixed to the central portion of the load transfer means for transferring force imposed on the load transfer means to the sidewalls.

2. The composite beam of claim 1, wherein the load transfer means comprises:

a load bearing member having first and second ends which extend through the load walls first and second, respectively, the attachment member being coupled to the second end of the load bearing member, the wall engagement portion being located on the first end of the load bearing member, opposite the attachment member; and a rigid load transfer body which is located within the interior of the outer casing between the first and second load walls, the load transfer body having a length substantially equal to the distance between the first and second load walls so that the first load wall bears against the load transfer body when force is applied to the first load wall by the wall engagement portion; and wherein;

the cross member means is fixed to the rigid load transfer body.

3. The composite beam of claim 2, wherein:

the load bearing member is a bolt which extends through the outer casing, the bolt having a head at the first end which forms the wall engagement portion; and wherein the attachment member is coupled to the bolt at the second end.

4. The composite beam of claim 3, further comprising:

an end plate which seats against the first load wall, and wherein the head of the bolt seats against the end plate.

5. The composite beam of claim 2, wherein:

the load transfer body is a cylindrical sleeve which surrounds the load bearing member.

6. The composite beam of claim 2, wherein:

the cross member means comprises at least one metal rod; and wherein the load transfer body has at least one recess for receiving an end of the metal rod so that the metal rod is rigidly held between the sidewall and the load transfer body.

7. The composite beam of claim 2, wherein:

the cross member means comprises two co-axial cross members, each cross member being closely received within the aperture of one of the sidewalls.

8. An improved composite beam comprising in combination:

an outer casing of resin impregnated fiberglass having first and second load walls which are joined together by laterally spaced apart opposite sidewalls, the first and second load walls each having an interior and exterior surface, and wherein each sidewall is generally parallel to the other with each of the sidewalls having an aperture formed therein;

an attachment member for securing a load to the composite beam;

a load bearing member which extends between the first and second load walls and has opposite first and second ends which extend through the first and second load walls, respectively, with the attachment member being coupled to the second end, the first end of the load bearing member having a wall engagement portion which seats against-the exterior surface of the first load wall so that force is exerted against the first load wall when the load is secured to the attachment member;

a rigid load transfer body which is located within the interior of the outer casing between the first and second load walls, the load transfer body having a length substantially equal to the distance between the first and second load walls so that the first load wall bears against the load transfer body when force is applied to the first load wall by the wall engagement portion; and cross member means which is closely received within the apertures of the sidewalls and which is fixed to the load transfer body for transferring force imposed on the load transfer body by the first load wall to the sidewalls to distribute the load.

9. The composite beam of claim 8, wherein:

the outer casing has a generally rectangular cross section.

10. The composite beam of claim 8, wherein:

the load bearing member is a bolt which extends through the outer casing, the bolt having a head at the first end which forms the wall engagement portion; and wherein the attachment member is coupled to the bolt at the second opposite end.

11. The composite beam of claim 10, further comprising:

an end plate which seats against the first load wall, and wherein the head of the bolt seats against the end plate.

12. The composite beam of claim 8, wherein:

the load transfer body is a cylindrical sleeve which surrounds the load bearing member.

13. The composite beam of claim 8, wherein:

the cross member means comprises at least one metal rod; and wherein the load transfer body has at least one recess for receiving an end of the metal rod so that the metal rod is rigidly held between the sidewall and the load transfer body.

14. The composite beam of claim 8, wherein:

the cross member means comprises two co-axial cross members, each cross member being closely received within the aperture of one of the sidewalls.

15. An improved composite beam for use as a utility pole cross arm comprising in combination:

an outer casing of resin impregnated fiberglass having a generally rectangular cross section with first and second load walls which are joined together by laterally spaced apart opposite sidewalls, the first and second load walls each having an interior and exterior surface, and wherein each sidewall is generally parallel to the other with each sidewall having an aperture formed therein;

an attachment member for securing a load to the composite beam;

a sleeve which is located within the interior of the outer casing between the first and second load walls, the sleeve having a bore extending therethrough, the sleeve having a recess formed in a side of the sleeve, the sleeve having a length substantially equal to the distance between the first and second load walls;

a load bearing member which extends between the first and second load walls through the bore of the sleeve, the load bearing member having first and second ends which extend through the first and second load walls, respectively, with the attachment member being coupled to the second end, the first opposite end having a wall engagement portion which seats against the exterior surface of the first load wall; and a pair of cross members, each cross member being closely received within one of the apertures of the sidewalls and one of the recesses of the sleeve so that force applied to the attachment member acts through the load bearing member to the sleeve and through the cross member to the sidewalls.

16. The composite beam of claim 15, wherein:

the load bearing member is a bolt which extends through the outer casing, the bolt having a head at the first end which forms the wall engagement portion; and wherein the attachment member is coupled to the bolt at the second end.

17. The composite beam of claim 16, further comprising:

an end plate which seats against the first load wall, and wherein the head of the bolt seats against the end plate.

18. The composite beam of claim 15, wherein:

the cross member is a metal rod.

19. The composite beam of claim 16, further comprising:

a second end plate which seats against the second load wall.

20. A method of securing a load to a composite beam formed from an outer casing of resin impregnated fiberglass, the outer casing having first and second load walls which are joined together by laterally spaced apart opposite sidewalls, the first and second load walls each having an interior and exterior surface, and wherein each sidewall is generally parallel to the other, the method comprising the steps of:

forming an aperture in each of the sidewalls;

providing load transfer means having a central portion which locates within the interior of the casing between the first and second walls, the load transfer means having first and second opposite ends which extend from the central portion through the first and second walls, respectively, the first end having a wall engagement portion which seats against the exterior surface of the first load wall;

coupling an attachment member to the second ends of the load transfer means for securing the load to the beam; and positioning cross member means within the apertures of the sidewalls; and fixing the cross member means to the central portion of the load transfer means for transferring force imposed on the load transfer means through the cross member means to the sidewalls.

* * * * *